US011898544B2

(12) United States Patent
Sadakata et al.

(10) Patent No.: US 11,898,544 B2
(45) Date of Patent: Feb. 13, 2024

(54) PACKAGE TYPE FLUID MACHINE

(71) Applicant: Hitachi Industrial Equipment Systems Co., Ltd., Tokyo (JP)

(72) Inventors: Kosuke Sadakata, Tokyo (JP); Hiroaki Saito, Tokyo (JP); Daichi Oka, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 338 days.

(21) Appl. No.: 17/267,972

(22) PCT Filed: Sep. 13, 2018

(86) PCT No.: PCT/JP2018/033916
§ 371 (c)(1),
(2) Date: Feb. 11, 2021

(87) PCT Pub. No.: WO2020/054009
PCT Pub. Date: Mar. 19, 2020

(65) Prior Publication Data

US 2021/0215147 A1 Jul. 15, 2021

(51) Int. Cl.

| | |
|---|---|
| ***F04B 39/06*** | (2006.01) |
| ***F04B 39/12*** | (2006.01) |
| ***F04B 53/08*** | (2006.01) |
| ***F04C 29/04*** | (2006.01) |
| ***F04C 21/00*** | (2006.01) |

(52) U.S. Cl.
CPC ..... *F04B 39/06* (2013.01); *F04B 39/066* (2013.01); *F04B 39/121* (2013.01); *F04B 53/08* (2013.01); *F04C 21/007* (2013.01); *F04C 29/047* (2013.01)

(58) Field of Classification Search
CPC ..... F04B 53/08; F04B 39/066; F04B 39/121; F04B 39/06; F04C 29/047; F04C 21/007
See application file for complete search history.

(56) References Cited

U.S. PATENT DOCUMENTS

| | | | | |
|---|---|---|---|---|
| 10,227,981 | B2 * | 3/2019 | Kanaizumi | F01C 21/007 |
| 10,359,044 | B2 * | 7/2019 | Kawano | F04C 23/001 |
| 11,026,354 | B2 * | 6/2021 | Ledezma | H05K 7/20927 |

(Continued)

FOREIGN PATENT DOCUMENTS

| | | |
|---|---|---|
| EP | 1 517 043 A2 | 3/2005 |
| JP | 55-4503 U | 1/1980 |

(Continued)

OTHER PUBLICATIONS

International Search Report (PCT/ISA/210) issued in PCT Application No. PCT/JP2018/033916 dated Dec. 11, 2018 with English translation (four (4) pages).

(Continued)

*Primary Examiner* — Christopher S Bobish
(74) *Attorney, Agent, or Firm* — Crowell & Moring LLP

(57) ABSTRACT

A package type fluid machine includes a plurality of compressor bodies; a machine compartment in which the plurality of compressor bodies are disposed; an exhaust duct that exhausts a cooling gas from the machine compartment; a plurality of aftercoolers that are disposed inside the exhaust duct to cool a compressed fluid from the compressor bodies; and a shield that is disposed between the aftercoolers to shield a flow of the cooling gas.

12 Claims, 9 Drawing Sheets

(56) References Cited

U.S. PATENT DOCUMENTS

| | | | | |
|---|---|---|---|---|
| 2005/0063844 | A1* | 3/2005 | Sato | F04C 23/00 417/423.1 |
| 2014/0314586 | A1 | 10/2014 | Kanaizumi | |
| 2016/0097389 | A1* | 4/2016 | Yamazaki | F04C 29/04 417/410.5 |
| 2017/0218958 | A1* | 8/2017 | Seaver | F04C 29/04 |
| 2018/0030984 | A1* | 2/2018 | Sato | F04C 29/04 |

FOREIGN PATENT DOCUMENTS

| | | | |
|---|---|---|---|
| JP | 2-49458 | A | 2/1990 |
| JP | 4-332196 | A | 11/1992 |
| JP | 9-46076 | A | 2/1997 |
| JP | 11-274749 | A | 10/1999 |
| JP | 2014-51946 | A | 3/2014 |
| JP | 2016-145557 | A | 8/2016 |

OTHER PUBLICATIONS

Japanese-language Written Opinion (PCT/ISA/237) issued in PCT Application No. PCT/JP2018/033916 dated Dec. 11, 2018 (four (4) pages).

English translation of document B2 (Doc No. (JP 4-332196 A) previously filed on Feb. 11, 2021) (seven (7) pages).

Chinese-language Office Action issued in Chinese Application No. 201880095780.9 dated Mar. 3, 2022 with English translation (14 pages).

Extended European Search Report issued in European Application No. 18933643.1 dated Feb. 3, 2022 (eight (8) pages).

* cited by examiner

ON
OFF
1
2
3
7
40
41
42
50
51
52
60
61

PACKAGE TYPE FLUID MACHINE

TECHNICAL FIELD

The present invention relates to a package type fluid machine, particularly to a package type fluid machine having stabilized cooling performance.

BACKGROUND ART

There is known a gas compressor that generates a compressed gas used as a power source of a production line or an air source for a machine tool, a press machine, an air blower, or the like. When the gas compressor is, for example, a scroll compressor, the gas compressor includes a compressor body that includes a scroll orbiting eccentrically, a fixed scroll, and an end plate facing the scrolls to compress a gas in a compression chamber of which the volume is changed by operation, and is configured to discharge the compressed gas from a discharge port to a gas tank via a discharge pipe.

In addition, there is a package type fluid machine that includes a plurality of fluid machine units in a casing to save space.

There is Patent Document 1 as the background art relating to the package type fluid machine. The package type fluid machine of Patent Document 1 includes at least one suction port which communicates with an installation region of a plurality of fluid machine units stacked in stages and through which a gas for cooling flows in; a plurality of exhaust passages that are provided inside a casing and include a first exhaust passage through which the gas that has passed through fluid machines of the plurality of fluid machine units flows, and a second exhaust passage different from the first exhaust passage; and one exhaust port which is provided in the casing to communicate with a downstream end portion of the plurality of exhaust passages to collect and exhaust the gas that has flown through the plurality of exhaust passages. It is stated that with such a configuration, a duct attachable for exhaust can be reduced in size and noise can be reduced.

CITATION LIST

Patent Document

Patent Document 1: JP 2016-145557 A

SUMMARY OF THE INVENTION

Problems to be Solved by the Invention

In Patent Document 1, when all compressor bodies of the fluid machine units operate, the compressor bodies being stacked in a plurality of stages, there is a possibility that the amount of cooling air of a compressor located the farthest from the exhaust port is block by cooling air of other compressors, so that the cooling performance deteriorates and the performance and reliability are affected.

In addition, it is considered a possibility that when for example, one or two compressor bodies operate among compressor bodies used in the same exhaust passage, due to differential pressure between the exhaust passage and the installation region where the compressor bodies are installed, a backflow occurs from a passage of cooling air of a compressor body which is not in operation, to increase the temperature of the installation region.

It is considered that depending on the operating condition of the compressor bodies, the flow direction and the amount of cooling air change and a difference occurs in temperature between the compressor bodies to cause a decrease in performance and a reliability problem.

An object of the present invention is to provide a package type fluid machine capable of stabilizing cooling performance regardless of an operating condition of compressor bodies.

Solutions to Problems

According to an exemplary example, there is provided a package type fluid machine including: a plurality of compressor bodies; a machine compartment in which the plurality of compressor bodies are disposed; an exhaust duct that exhausts a cooling gas from the machine compartment; a plurality of aftercoolers that are disposed inside the exhaust duct to cool a compressed fluid from the compressor bodies; and a shield that is disposed between the aftercoolers to shield a flow of the cooling gas.

Effects of the Invention

According to the present invention, the cooling performance can be stabilized regardless of an operating condition of the compressor bodies.

MODE FOR CARRYING OUT THE INVENTION

First, when an embodiment of the present invention is not applied to compressor bodies of a fluid machine unit, the compressor bodies being stacked in a plurality of stages, how cooling air flows depending on an operation state will be described using a comparative example illustrated in FIG. 1.

Figures 1A, 1B, 1C:
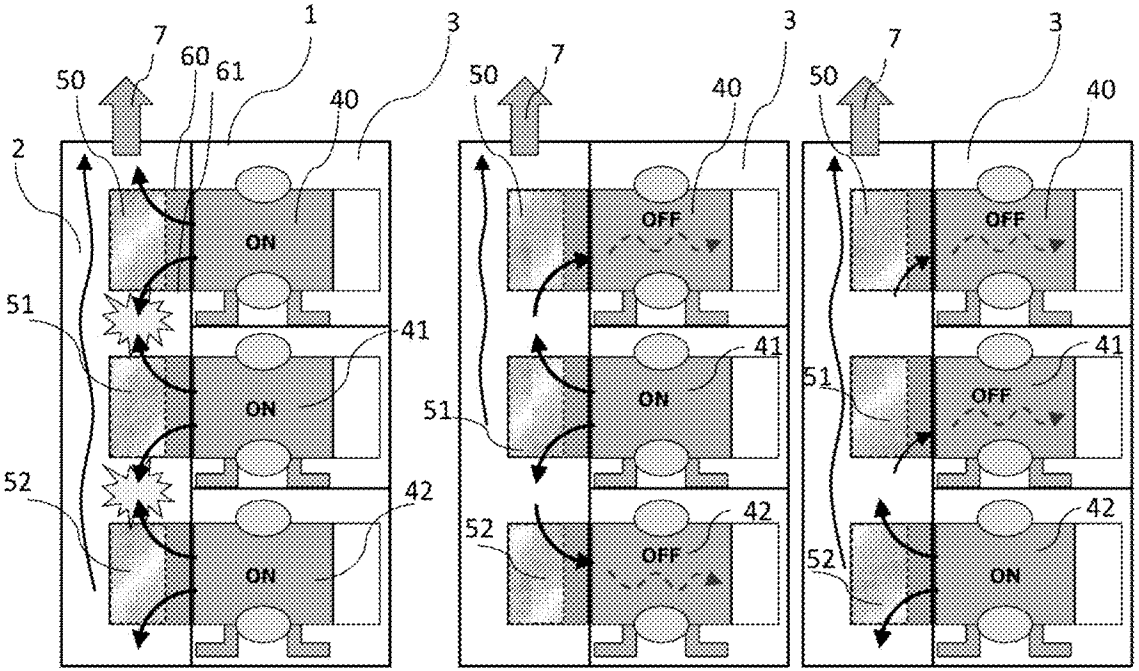
FIGS. 1A to 1C are views describing a comparative example.

FIG. 1 is an internal configuration view of a package type fluid machine in the comparative example when seen from front. FIG. 1(*a*) is a view illustrating the flow of cooling air in the operation state for when all compressor bodies 40, 41, and 42 vertically stacked in three stages operate (ON).

FIG. 1(*b*) is a view illustrating the flow of cooling air when only the compressor body 41 of a middle stage operates (ON) and the compressor bodies 40 and 42 of the other two stages are stopped (OFF) among the compressor bodies 40, 41, and 42 vertically stacked in three stages.

FIG. 1(*c*) is a view illustrating the flow of cooling air when only the compressor body 42 of the lowest stage operates (ON) and the compressor bodies 40 and 41 of the other two stages are stopped (OFF) among the compressor bodies 40, 41, and 42 vertically stacked in three stages.

As illustrated in FIG. 1(*a*), the cooling air flowing from a machine compartment 3 in which the compressor bodies are installed toward aftercoolers 50, 51, and 52 of an exhaust duct 2 includes not only cooling air flowing in an exhaust direction 7 but also cooling air flowing in a direction different from the exhaust direction 7. Since cooling air flowing downward from an upper stage side of the machine compartment 3 collides with cooling air flowing upward from a lower side of the machine compartment 3, the flow of the cooling air which should flow in the exhaust direction 7 is not sufficient, so that cooling performance is decreased.

In addition, as illustrated in FIG. 1(*b*) or 1(*c*), the cooling air which has passed through the aftercoolers 50, 51, and 52, which cool air compressed by the compressor body, to become very hot flows backward from the compressor body during operation (ON) to the compressor bodies at stop (OFF) as indicated by dotted lines, and the temperature of the machine compartment 3 is increased, so that the performance of the compressor is reduced due to intake heating.

Hereinafter, embodiments of the present invention will be described with reference to the drawings.

First Embodiment

Figure 2A:
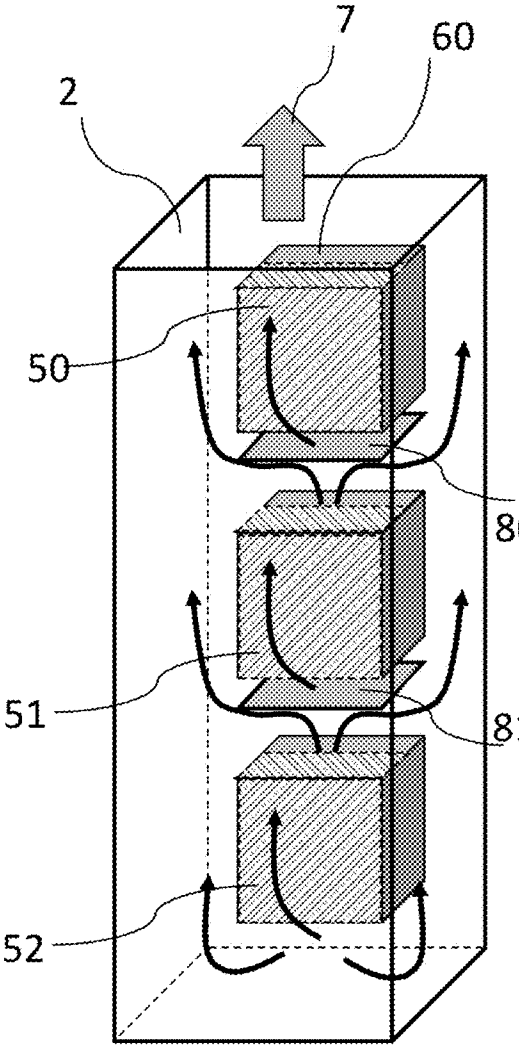
FIGS. 2A and 2B are views describing the inside of an exhaust duct in a first embodiment.
Figure 2B:
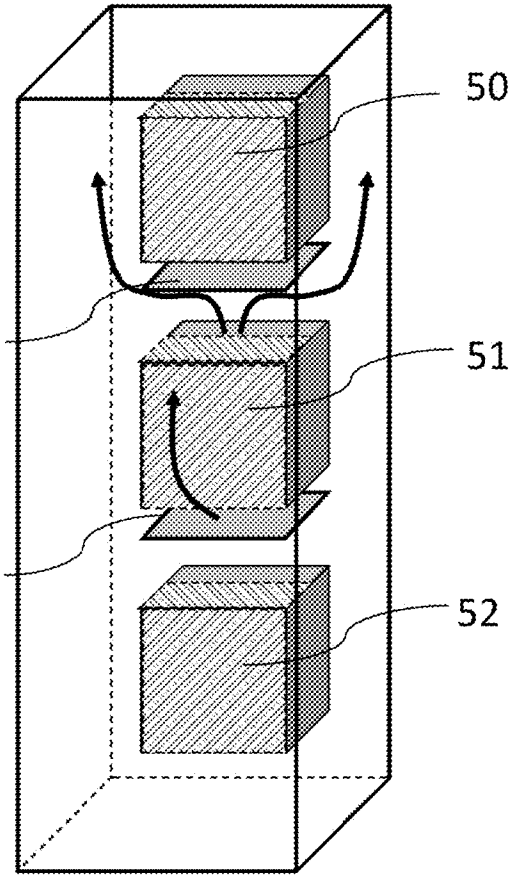

FIG. 2 is a view describing the inside of an exhaust duct of a package type fluid machine in a first embodiment.

FIG. 2(*a*) is a view illustrating the flow of cooling air inside the exhaust duct 2 in the operation state for when all compressor bodies vertically stacked in three stages operate (ON).

FIG. 2(*b*) is a view illustrating the flow of cooling air inside the exhaust duct 2 when the compressor body of a middle stage operates (ON) and the compressor bodies of upper and lower stages are stopped among the compressor bodies vertically stacked in three stages.

In the first embodiment, shielding plates 80 and 81 are installed between the aftercoolers 50, 51, and 52 arranged inside the exhaust duct 2. The cooling air that is a cooling gas which has cooled the compressor body 40 is divided into a flow passing through upper and lower gaps 60 and 61 and a flow passing through the insides of the aftercoolers 50, 51, and 52.

The flow which has passed through the upper gap 60 of the aftercooler 51 installed below flows to a side surface of the aftercooler 50 installed above the shielding plate 80. Accordingly, the cooling air which has passed through the aftercooler 51 below to become warm does not directly hit the aftercooler 50 installed above, so that the cooling performance of the aftercooler 50 above is improved.

In addition, since cooling airs from the compressor bodies 40, 41, and 42 do not directly interfere with each other, the cooling airs are smoothly exhausted, so that the cooling performance of the entire package is improved.

In addition, since cooling air from the lower gap 61 of the aftercooler 50 above also flows along the shielding plate 80, there is no flow colliding with the aftercooler 51 below, so that the cooling performance of the aftercooler 51 below is also improved.

Figure 3:
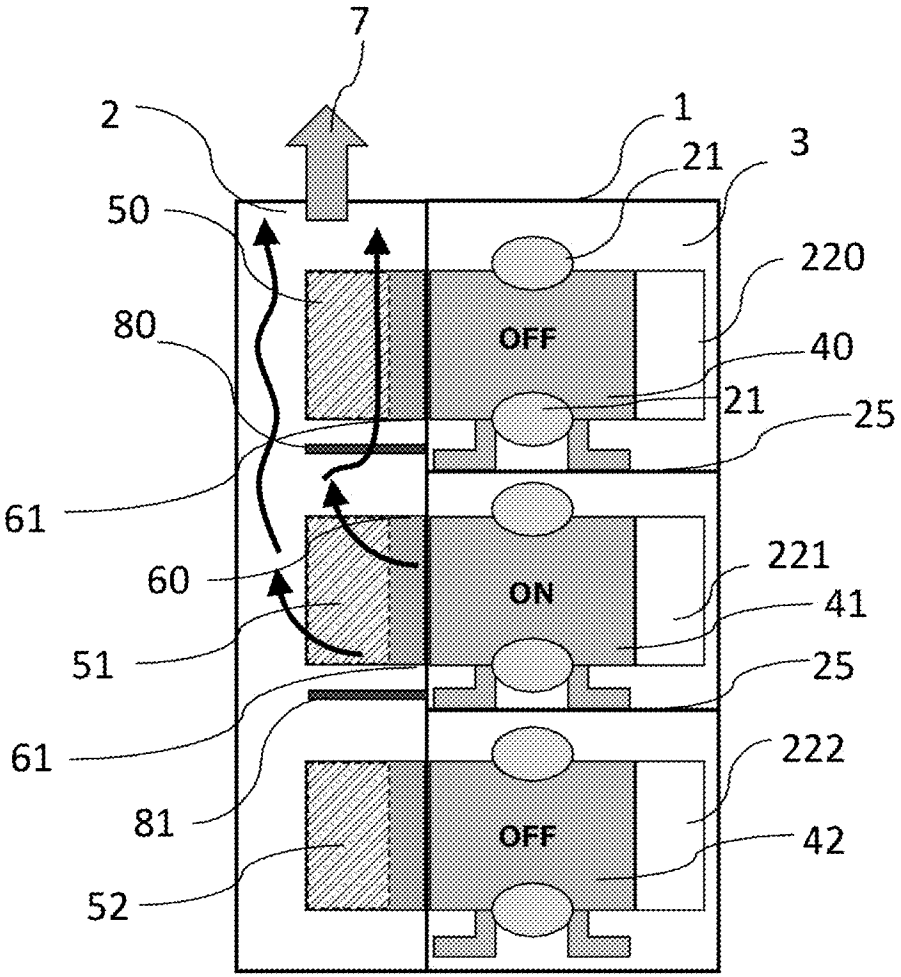
FIG. 3 is an internal configuration view of a package type fluid machine in the first embodiment when seen from front.

FIG. 3 is an internal configuration view of a package type fluid machine in the first embodiment when seen from front.

When seen from front, the machine compartment 3 in which the compressor bodies 40, 41, and 42 having a three-stage configuration are installed is provided on a right side inside a casing 1. When seen from front, the exhaust duct 2, which exhausts the cooling air which is a cooling gas cooling the compressor bodies and the aftercoolers, is provided on a left side.

The aftercoolers 50, 51, and 52 having a three-stage configuration are disposed inside the exhaust duct 2. The aftercoolers 50, 51, and 52 are fixed to the vicinity of an opening between the exhaust duct 2 and the machine compartment 3 with a fixing portion such as a metal fitting (not illustrated).

The fixing portion is structured to have a side surface in a horizontal direction of the package type fluid machine and to form the upper and lower gaps 60 and 61. The cooling air which has cooled the compressor bodies flows into the exhaust duct through the opening provided between the machine compartment 3 and the exhaust duct 2. Then, the cooling air flows from the upper and lower gaps 60 and 61 through the exhaust duct 2 as indicated by arrows.

Cooling ducts 220, 221, and 222 are provided on right side surfaces of the compressor bodies 40, 41, and 42, respectively. A cooling fan (not illustrated) provided on a back surface side of the compressor bodies 40, 41, and 42 is driven, so that cooling air passes through the cooling ducts 220, 221, and 222 to be sent to a front surface of the package type fluid machine to cool the compressor bodies 40, 41, and 42.

Each of the compressor bodies 40, 41, and 42 includes two filters 21 that take in air which is a fluid to be compressed. The fluid taken into the compressor bodies 40, 41, and 42 from the filters 21 is compressed in the compressor bodies to be sent to the aftercoolers 50, 51, and 52 through gas pipes to be cooled.

In FIG. 3, a partition shelf 25 on which the compressor bodies 40 and 41 are mounted and the shielding plates 80 and 81 are separate bodies; however, the shielding plates 80 and 81 may be formed as a part of the partition shelf 25.

In the present embodiment, the compressor body uses a scroll compressor, but may be other compressors such as a reciprocating compressor.

According to the first embodiment, as illustrated in FIG. 3, for example, when the compressor body 41 of the middle stage operates (ON), the shielding plate 80 causes the cooling air of the compressor body 41 during operation (ON) to flow to a side surface side of the aftercooler 50 of the stage above at stop (OFF), so that the cooling air can be suppressed from directly hitting the aftercooler 50.

Further, the cooling air of the compressor body 41 which operates flows out from the lower gap 61, and a flow flowing into an aftercooler 52 side below can be suppressed by the shielding plate 81. Therefore, a backflow of the cooling air from the exhaust duct 2 to a machine compartment 3 side can be reduced. Accordingly, a rise in temperature of the machine compartment 3 can be reduced, so that the performance and reliability are improved.

Even when any one of the plurality of compressor bodies 41, and 42 installed operates, the flow of cooling air can be controlled similarly, and thus the cooling performance can be stabilized regardless of an operating condition of the compressor bodies.

Second Embodiment

Figure 4:
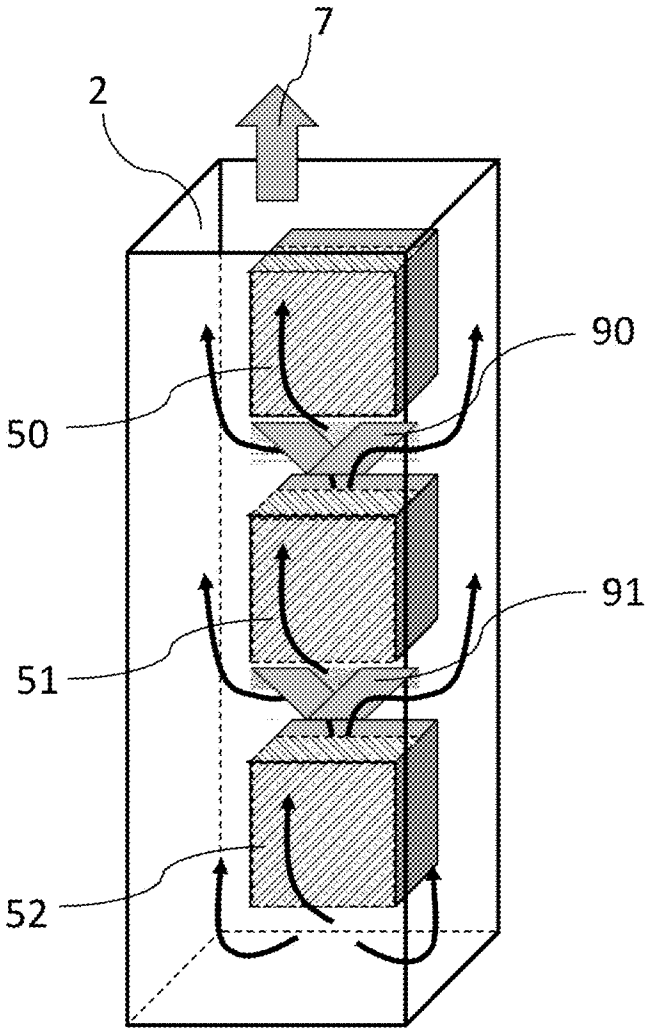
FIG. 4 is a view describing the inside of an exhaust duct in a second embodiment.

FIG. 4 is a view describing the inside of an exhaust duct of a package type fluid machine in a second embodiment. The description of the same contents as those of the first embodiment will be omitted.

In the present embodiment, the shielding plates 80 and 81 which are flat plates in the first embodiment are replaced with shielding plates 90 and 91 each having a V shape. Since the shielding plate is formed in a V shape, a flow from a side surface side of the aftercoolers 50, 51, and 52 toward the exhaust direction 7 is facilitated, so that the cooling performance is improved and the performance and reliability can be improved.

Third Embodiment

Figure 5:
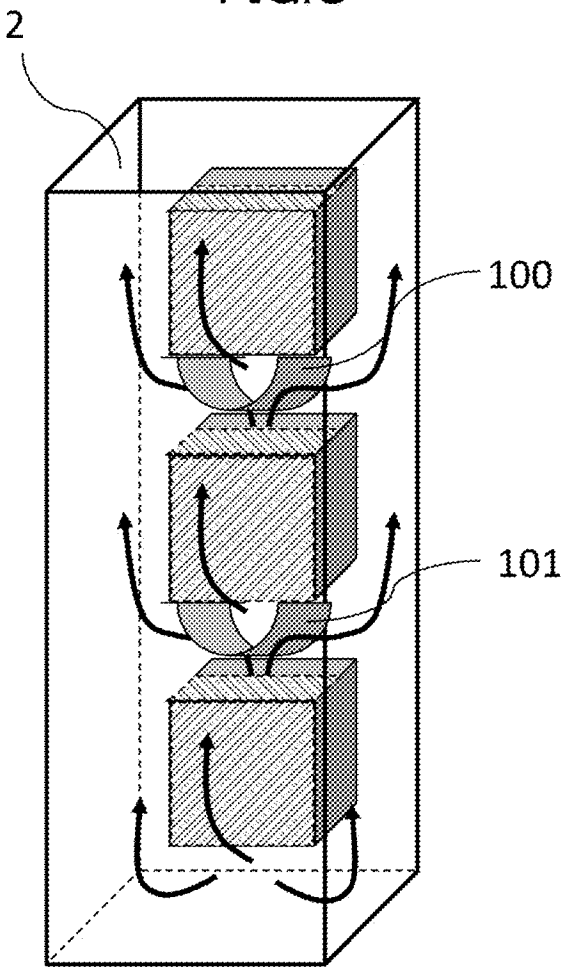
FIG. 5 is a view describing the inside of an exhaust duct in a third embodiment.

FIG. 5 is a view describing the inside of an exhaust duct of a package type fluid machine in a third embodiment. The description of the same contents as those of the first embodiment will be omitted.

In the present embodiment, the shielding plates 80 and 81 which are flat plates in the first embodiment are replaced with shielding plates 100 and 101 each having a U shape (including a semicircular shape), so that the same effects as those of the first and second embodiments can be obtained.

Fourth Embodiment

Figure 6:
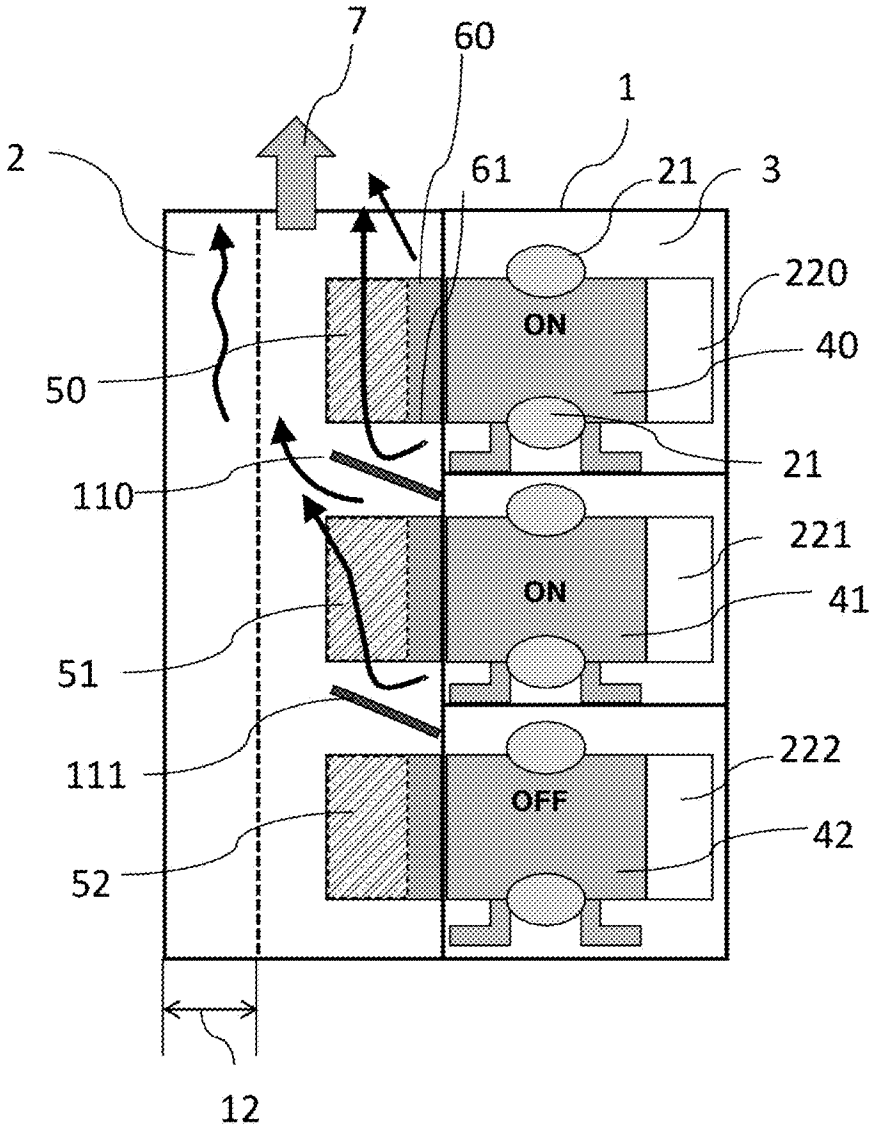
FIG. 6 is an internal configuration view of a package type fluid machine in a fourth embodiment when seen from front.
Figure 7:
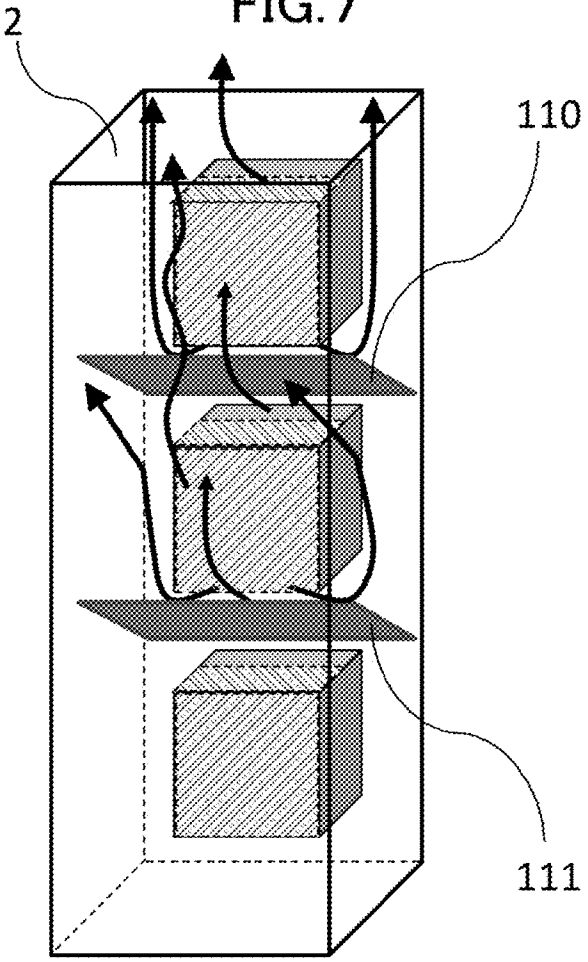
FIG. 7 is a view describing the inside of an exhaust duct in the fourth embodiment.

FIG. 6 is an internal configuration view of a package type fluid machine in a fourth embodiment when seen from front. FIG. 7 is a view describing the inside of an exhaust duct in the fourth embodiment. The description of the same contents as those of the first embodiment will be omitted.

The fourth embodiment has a configuration where shielding plates 110 and 111 of the exhaust duct 2 are disposed to be inclined obliquely toward the exhaust direction 7, and are in contact with a side surface on a front surface side and a side surface on a back surface side of the package type fluid machine among side surfaces in a longitudinal direction of the exhaust duct 2.

In the fourth embodiment, the shielding plates 110 and 111 abut against the exhaust duct 2 in a forward and rearward direction, so that the passage of the cooling air which has passed by the side surfaces of the aftercoolers 50, 51, and 52 is narrower than those of the other embodiments. Therefore, the exhaust duct 2 is lengthened in the horizontal direction by a width indicated by reference sign 12 to widen the exhaust duct 2, so that the passage of the cooling air is secured.

Since the exhaust duct 2 is longer in the horizontal direction by the width indicated by reference sign 12 than those of the other embodiments, the flow of the cooling air is separated from the aftercoolers 50, 51, and 52, so that the cooling performance of the aftercooler 50 is improved. In addition, a backflow to the machine compartment 3 can be prevented. For this reason, the cooling efficiency can be increased. Accordingly, the reliability is improved.

Fifth Embodiment

Figure 8:
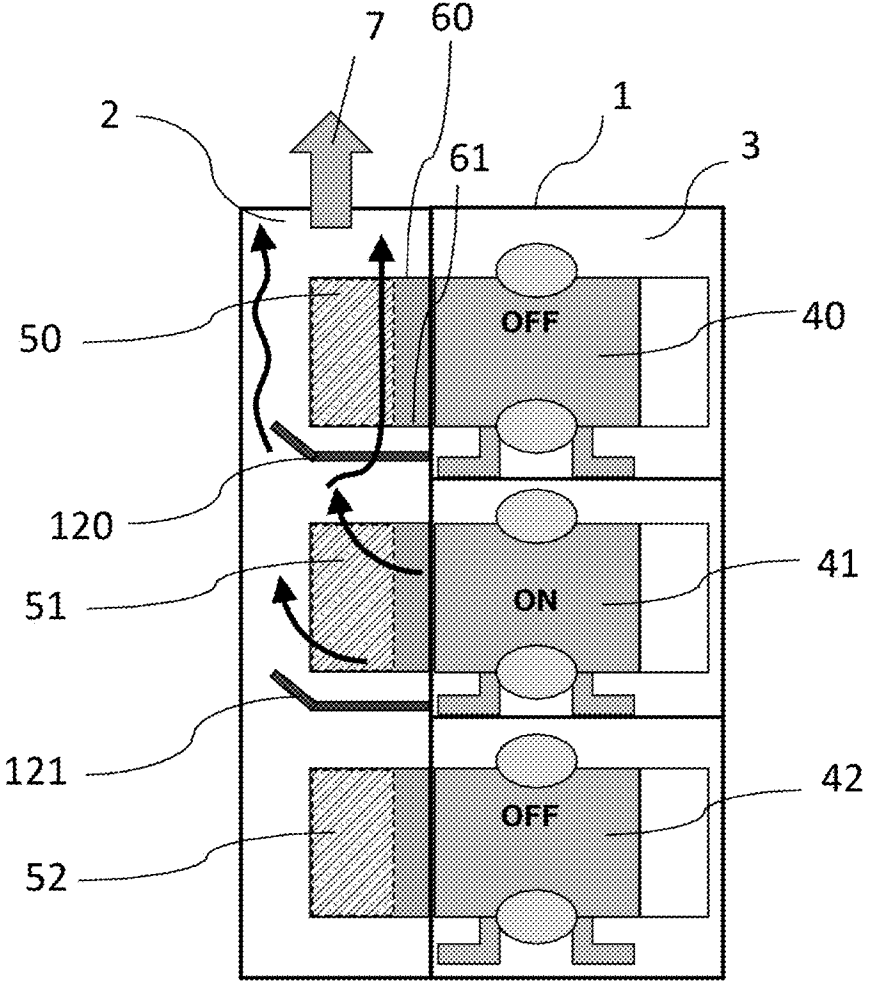
FIG. 8 is an internal configuration view of a package type fluid machine in a fifth embodiment when seen from front.

FIG. 8 is an internal configuration view of a package type fluid machine in a fifth embodiment when seen from front.

Figure 9:
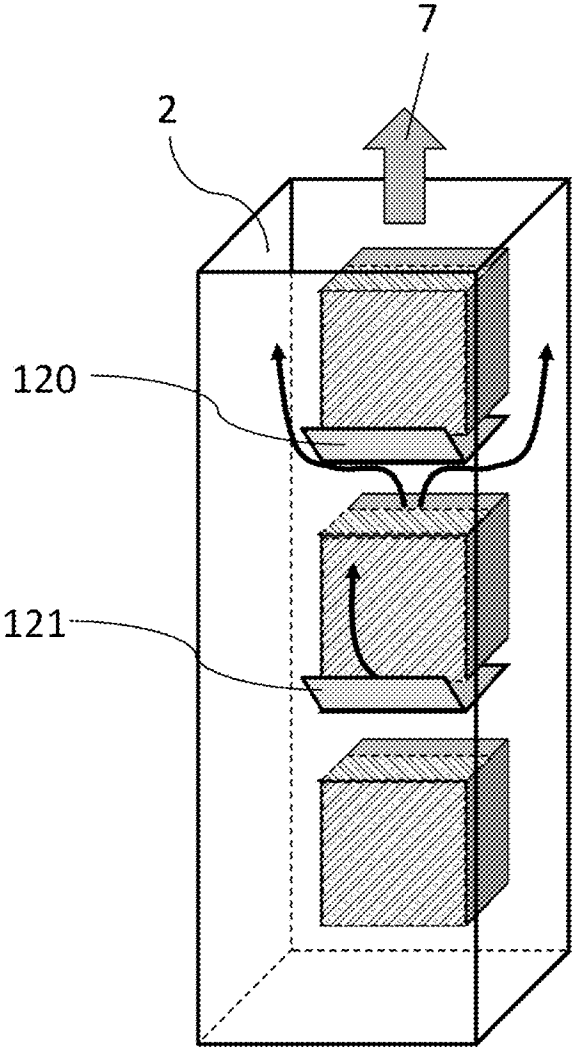
FIG. 9 is a view describing the inside of an exhaust duct in the fifth embodiment.

FIG. 9 is a view describing the inside of an exhaust duct in the fifth embodiment. The description of the same contents as those of the first embodiment will be omitted.

Regarding shielding plates of the fifth embodiment, the shielding plates 80 and 81 which are flat plates in the first embodiment are replaced with shielding plates 120 and 121 each having a shape in which the tip of each thereof is bent toward the exhaust direction 7. The present embodiment exhibits an effect that warm cooling air can be released from sides and a tip side of the shielding plates 120 and 121.

In the embodiments, the package type fluid machine including the compressor bodies of three stages in the vertical direction has been described as an example; however, the number of stages is not limited to 3, and a plurality of stages may be provided to make the set area of the package type fluid machine compact.

In addition, the present invention is also applicable to a package type fluid machine including the plurality of compressor bodies and aftercoolers in a plurality of stages in the horizontal direction instead of in the vertical direction. In that case, the package type fluid machine of the embodiment can be installed in a place with restriction in a height direction.

In addition, the present invention is also applicable to a package type fluid machine including the plurality of compressor bodies and aftercoolers in a plurality of stages in the vertical direction and the horizontal direction. In that case, the bulk density of the compressor bodies is increased, so that the cooling performance can be stabilized regardless of an operating condition of the compressor bodies.

REFERENCE SIGNS LIST

1 Casing
2 Exhaust duct
3 Machine compartment
40, 41, 42 Compressor body
50, 51, 52 Aftercooler
60 Upper gap
61 Lower gap
7 Exhaust direction
80, 81 Shielding plate (first embodiment)
90, 91 Shielding plate (second embodiment)
100, 101 Shielding plate (third embodiment)
110, 111 Shielding plate (fourth embodiment)
120, 121 Shielding plate (fifth embodiment)

The invention claimed is:

1. A package type fluid machine comprising:
a plurality of compressor bodies;
a machine compartment in which the plurality of compressor bodies are disposed;
an exhaust duct that exhausts a cooling gas from the machine compartment;
a plurality of aftercoolers that are disposed inside the exhaust duct to cool a compressed fluid from the compressor bodies; and
a shield that is disposed between the aftercoolers to shield a flow of the cooling gas, wherein
the shield is provided on an inner wall of the exhaust duct, and
the shield is located between a first aftercooler and a second aftercooler.

2. The package type fluid machine according to claim 1, wherein the compressor bodies and the aftercoolers are disposed in a plurality of stages in a vertical direction.

3. The package type fluid machine according to claim 2, wherein the shield is a shielding plate, and
an opening through which the cooling gas flows is provided between the exhaust duct and the machine compartment.

4. The package type fluid machine according to claim 2, wherein the shield is a shielding plate having a V shape and extending in an exhaust direction in which the exhaust duct exhausts the cooling gas, such that a flow from a side surface of the aftercoolers toward the exhaust direction is facilitated.

5. The package type fluid machine according to claim 2, wherein the shield is a shielding plate having a U shape and extending in a direction in which the exhaust duct exhausts the cooling gas.

6. The package type fluid machine according to claim 2, wherein the shield is a shielding plate in contact with a side surface in a longitudinal direction of the exhaust duct.

7. The package type fluid machine according to claim 2, wherein the shield has a shape in which a tip of the shield is bent in a direction in which the exhaust duct exhausts the cooling gas.

8. The package type fluid machine according to claim 1, further comprising:

a cooling fan disposed in the machine compartment; and a cooling duct that supplies a flow of the cooling gas, which the cooling fan is driven to generate, to the compressor bodies.

9. The package type fluid machine according to claim 2, wherein the compressor body of each stage is disposed on a partition shelf, and the shield is a part of the shelf.

10. The package type fluid machine according to claim 1, wherein the plurality of compressor bodies and the plurality of aftercoolers are disposed in a horizontal direction.

11. The package type fluid machine according to claim 1, wherein the plurality of compressor bodies and the plurality of aftercoolers are disposed in a horizontal direction and a vertical direction.

12. The package type fluid machine according to claim 1, further comprising:

a gap in a direction in which the cooling gas is exhausted; and a fixing portion that fixes the aftercoolers inside the exhaust duct, wherein the fixing portion is disposed in the vicinity of an opening through which the cooling gas passes from the compressor bodies.

* * * * *